United States Patent [19]

Margold

[11] 4,379,709

[45] Apr. 12, 1983

[54] PROCESS FOR DISINFECTING AND PRESERVING HIDES AND SKINS

[75] Inventor: Franz Margold, Seeheim-Jugenheim, Fed. Rep. of Germany

[73] Assignee: Riedel de Haen Aktiengesellschaft, Seelze, Fed. Rep. of Germany

[21] Appl. No.: 274,388

[22] Filed: Jun. 17, 1981

[30] Foreign Application Priority Data

Jun. 19, 1980 [DE] Fed. Rep. of Germany ..... 3022849

[51] Int. Cl.[3] ..... C14C 9/00

[52] U.S. Cl. ..... 8/94.18; 8/94.14; 8/94.15

[58] Field of Search ..... 8/94.14, 94.15, 94.18

[56] References Cited

U.S. PATENT DOCUMENTS 1,596,471 8/1926 Wesenberg ..... 8/94.14

FOREIGN PATENT DOCUMENTS 2623525 12/1977 Fed. Rep. of Germany .
1094217 12/1967 United Kingdom ..... 8/94.15
596621 2/1978 U.S.S.R. ..... 8/94.14

OTHER PUBLICATIONS

Margold et al., *Das Leder,* vol. 28 (1977) pp. 65–73.
Margold, Leder-und Haute-Markt, vol. 31 (1979) No. 29, pp. 530–534.
Pauckner et al., Leder-und Haute-Markt, vol. 32 (1980) No. 13, pp. 194–210.
F. Stather, Gerbereichemie und -Technologie, 4th Edition (1967), pp. 122 and 123.

*Primary Examiner*—Maria Parrish Tungol
*Attorney, Agent, or Firm*—Curtis, Morris & Safford

[57] ABSTRACT

Hides and skins are disinfected and preserved by contacting them with a mixture of an inorganic zinc salt and an acid amide and subsequently with common salt and an acid having a disinfectant and preservative action. The mixture of zinc salt and acid amide is used in general in an amount of at most 2 weight %. The efficiency of the mixture may be improved by using additionally a further organic preservative. Carboxylic acids are especially suitable for the aftertreatment using a salt-acid pickle. The process is particularly appropriate for preserving hides and skins as well as furskins of different kinds and provenance.

6 Claims, No Drawings

PROCESS FOR DISINFECTING AND PRESERVING HIDES AND SKINS

The present invention relates to a process for disinfecting hides and skins (hereinafter referred to as hides) by a treatment with substances having a disinfectant and preservative action.

It is known to preserve hides by using combinations of inorganic zinc, tin and sodium compounds with organic acid amides or methylol compounds thereof and halogenated phenols (cf. German Offenlegungsschrift No. 2,623,525). These combinations used for preservation purposes may furthermore contain common salt or sodium sulfate as a diluent so that there result mixtures containing 70% of salt and 30% of preserving chemicals.

Preservation combinations of the above type are mainly used for short-time preservation, that is a period of from one to two weeks (cf. Das Leder 28 (1977), page 65).

It is further known that the long-time preservation of hides using salt in concentrations below 40% requires a minimum quantity of chemical preservatives, which latter amounts to about 1.5% in the case of synergistic preservation mixtures (cf. Leder- und Häute-Markt 31 (1979), number 29, page 530). A minimum salt content of about 15% is required in order to render the hides appropriate for piling and to maintain their aptitude for cutting during the cropping process.

It has been furthermore proposed to preserve hides with bactericidal agents alone or in admixture with a small quantity of salt. A preservation of this type using commercial agents resulted in some cases in a storage time of 40 days and in one case in a storage time of 100 days. The salt quantity should amount to 5 to 10% of the weight of the hide. The treatment with common salt is the commonly applied process for reaching a preservative effect in hides for the period of time extending from the moment at which the hides are flayed from the carcass to the input of the hides for tanning, while the drying and pickling steps, which latter mean a treatment with a salt and an acid, are of secondary importance only (cf. Leder- und Häute-Markt 32 (1980), number 13, page 194).

It is the object of the present invention to improve the preservative treatment of fresh hides with substances and methods known per se in order to reach a long-time preservation, while the effluent load with salt is reduced.

The present invention relates to a process for disinfecting and preserving hides by treating them with substances having a disinfectant and preservative action, which comprises contacting the hides with a mixture consisting of an inorganic zinc salt and an acid amide, optionally in combination with at least one further nitrogen-containing organic preservative, and subsequently with common salt and an acid having a disinfectant and preserving action.

The mixture consisting of zinc salt and acid amide is generally used in an amount of at most 2 weight %, preferably in an amount of at most 1.5 weight %, referred to the hides, a quantity of from 0.5 to 1 weight %, referred to the hides, being generally sufficient to obtain a preservative efect for several months. The optimal quantity of the mixture of zinc salt and acid depends mainly on the nature and the state of the halides to be preserved and the temperature during the storage of the hides. The weight ratio of zinc salt to acid amide is preferably in the range of from 3:1 to 1:1.

Suitable zinc salts are in particular zinc salts of a halogen-containing or sulfur-containing inorganic acid, for example zinc chloride, zinc fluoride, zinc hexafluorosilicate and zinc sulfate.

Suitable acid amides are in particular amides of a carboxylic acid having from 2 to 12 carbon atoms, preferably 2 to 6 carbon atoms, or of an aromatic sulfonic acid having from 6 to 8 atoms, the acid amides containing optionally a hydroxy group. Particularly suitable are amides of a chlorine-containing lower carboxylic acid, for example chloroacetamide, N-methylolchloroacetamide, dichloroacetamide, trichloroacetamide and the homologous N-methylol derivatives. Further examples are benzene-sulfonic acid amide, p-toluene-sulfonic acid amide and undecylenic acid amide.

A substantial feature of the preservation process according to the invention resides in the aftertreatment of the hides using a salt-acid pickle, that is a treatment with common salt and an acid having a disinfectant and preservative action. The quantity of acid used depends on the nature of the hides to be preserved and varies preferably from 0.5 to 2.5 weight %, referred to the hides. The quantity of common salt is preferably in the range of from 5 to 10 weight %, referred to the hides. Suitable acids are in particular monobasic or dibasic, optionally hydroxy groups-containing or oxo groups-containing, carboxylic acids having from 1 to 6, preferably 1 to 4, carbon atoms, for example formic acid, acetic acid, oxalic acid, glycolic acid, glyoxylic acid, lactic acid, tartaric acid and sorbic acid.

The zinc salt/acid amide mixture is optionally used in combination with at least one further nitrogen-containing organic preservative, the efficiency of the zinc salt/acid amide mixture thus being improved and the storability of the hides being lengthened. Suitable further preservatives are in particular quaternary ammonium bases, for example dialkyl dimethyl ammonium chlorides or benzyl dimethyl tetradecyl ammonium chloride, and water-soluble heterocyclic compounds containing 5 or 6 ring atoms, preferably thiazoline derivatives such as 2-methyl-4-isothiazolin-3-one and 5-chloro-2-methyl-4-isothiazolin-3-one as calcium chloride complex or 2-octyl-4-isothiazolin-3-one as well as triazine derivatives such as hexahydro-1,3,5-triazine.

The process according to the invention is carried out in two steps. In a first step the fresh hides are submitted to a preliminary washing with the one- to four-fold quantity of water in a container, for example a drum or a mixer, and subsequently they are contacted, while being constantly moved, with the zinc salt/acid amide mixture. A homogeneous distribution of the mixture on the hides, depending on the nature and the quantity of the hides, is reached in general within 30 minutes to 1 hour. Next there is added the common salt and the acid and the hides are further kept in motion at least until the moment at which the salt has dissolved completely. Thereafter the hides are piled in order to let the preservation liquor drip off. After 2 to 4 days, when a sufficient quantity of water has been removed from the hides, the latter are piled for storage purposes. The storability of the hides thus treated lasts for at least 1 year.

The process of the invention may be used for preserving hides or skins of any provenance and nature, in particular cattle hides, calfskins, sheep skins and goat skins as well as any kind of furskins.

A particular advantage of the process of the invention resides in the fact that the aftertreatment using the salt-acid pickle results in an accelerated water removal from the hides, a diminished lubricity of the hides, while simultaneously improving the disinfectant and preservative action of the zinc salt/acid amide mixture. A further advantage of the process of the invention resides in a lower effluent load, since there are used far lower quantities of salt, as compared to the conventional methods, that is only up to 25% of the hitherto used quantities.

The following examples serve to illustrate the invention. Percentages are by weight.

EXAMPLE 1

100 kg of freshly skinned cattle hides are submitted four times to a washing in a drum using each time 100 liters of water. The wet hides are thereafter contacted with a mixture consisting of 750 g of zinc chloride and of 750 g of N-methylol-chloroacetamide and agitated for 30 minutes. They are subsequently agitated for a further 30 minutes after addition of 7 kg of common salt and 1.5 kg of 85% formic acid, whereupon the salt has dissolved completely and the liquor has been absorbed completely by the hides. Thereafter the hides are superposed in order to let the liquor drip off. After 3 days, a sufficient quantity of water has been removed from the hides so that they can be piled up for storage purposes. The hides are still germ-free after a storage time of 14 months at a temperature of from 20° to 25° C.

EXAMPLE 2

100 kg of freshly skinned calfskins are submitted three times to a washing in a drum using each time 100 liters of water. The wet skins are thereafter contacted with a mixture consisting of 750 g of zinc sulfate and 500 g of chloroacetamide and agitated for 30 minutes. They are subsequently agitated for a further 30 minutes after addition of 7 kg of common salt and 1.2 kg of 50% glyoxylic acid, whereupon the salt has dissolved completely and the liquor has been completely absorbed by the skin. Thereafter the skins are drained on a horse for 2 days, whereupon they have dewatered to such a degree that they can be piled for storage purposes. A bacterial flora cannot be observed after a storage time of 12 months at a temperature of 30° C.

EXAMPLE 3

100 kg of freshly skinned cattle hides are submitted to a washing in a drum for 15 minutes using 300 liters of water. The wet hides are thereafter contacted with a mixture consisting of 500 g of zinc sulfate, 300 g of chloroacetamide, 150 g of 5-chloro-2-methyl-4-isothiazolin-3-one (calcium chloride complex) and 50 g of 2-methyl-4-isothiazolin-3-one (calcium chloride complex) and agitated for 30 minutes. They are agitated for a further 30 minutes after addition of 6.5 kg of common salt and 1.5 kg of tartaric acid, whereupon to salt has dissolved completely and the liquor has been completely absorbed by the hides. Next, the hides are drained on a horse for 2 days, whereupon they have been dewatered to such an extent that they can be palletized. A bacterial damage cannot be observed after a storage time of 12 months at a temperature of 30° C.

What is claimed is:

1. A process for disinfecting and preserving one or more hides or skins of any kind and provenance by treating it or them with one or more substances having a disinfectant and preservative action, which comprises contacting the one or more hides or skins with up to 2 weight %, calculated on the weight of said one or more hides or skins, of a mixture consisting of an inorganic zinc salt and an acid amide, or said mixture in combination with at least one further nitrogen-containing organic preservative, and subsequently with 5 to 10 weight %, calculated on the weight of said one or more hides or skins, of common salt and 0.5 to 2.5 weight %, calculated on the weight of said one or more hides and skins, of a mono- or dibasic carboxylic acid of from 1 to 6 carbon atoms.

2. A process as defined in claim 1, wherein the zinc salt is a zinc salt of a halogen-containing or sulfur-containing inorganic acid and the acid amide is an amide, or an amide containing a hydroxy group, of a carboxylic acid of from 2 to 12 carbon atoms or of an aromatic sulfonic acid of from 6 to 8 carbon atoms.

3. A process as defined in claim 1, which comprises contacting said one or more hides or skins with the zinc salt/acid amide mixture in combination with a quaternary ammonium compound, a heterocyclic compound containing 5 or 6 ring atoms, or a combination thereof.

4. A process for disinfecting and preserving one or more hides or skins of any kind and provenance by treating it or them with one or more substances having a disinfectant and preservative action, which consists essentially of contacting the one or more hides or skins with up to 2 weight %, calculated on the weight of said one or more hides or skins, of a mixture consisting of an inorganic zinc salt and an acid amide, or said mixture in combination with at least one further nitrogen-containing organic preservative, and subsequently with 5 to 10 weight %, calculated on the weight of said one or more hides or skins, of common salt and 0.5 to 2.5 weight %, calculated on the weight of said one or more hides and skins, of a mono- or dibasic carboxylic acid of from 1 to 6 carbon atoms.

5. A process as defined in claim 1 or 4, wherein said one or more hides or skins is contacted with up to 1.5 weight %, calculated on the weight of the hides or skins, of said mixture consisting of an inorganic zinc salt and an acid amide, or said mixture in combination with at least one further nitrogen-containing organic preservative.

6. A process as defined in claim 5, wherein said one or more hides or skins is contacted with 0.5 to 1 weight %, calculated on the weight of the hides or skins, of said mixture consisting of an inorganic zinc salt and an acid amide, or said mixture in combination with at least one further nitrogen-containing organic preservative.

* * * * *